US010590518B2

(12) United States Patent
Ji et al.

(10) Patent No.: US 10,590,518 B2
(45) Date of Patent: Mar. 17, 2020

(54) HIGH STRENGTH CAST ALUMINIUM ALLOY FOR HIGH PRESSURE DIE CASTING

(71) Applicant: Brunel University, Uxbridge, Middlesex (GB)

(72) Inventors: Shouxun Ji, Middlesex (GB); Zhongyun Fan, Middlesex (GB); Feng Yan, Middlesex (GB)

(73) Assignee: BRUNEL UNIVERSITY LONDON, Uxbridge, Middlesex (GB)

( * ) Notice: Subject to any disclaimer, the term of this patent is extended or adjusted under 35 U.S.C. 154(b) by 856 days.

(21) Appl. No.: 15/114,584

(22) PCT Filed: Feb. 10, 2015

(86) PCT No.: PCT/GB2015/050365

§ 371 (c)(1),
(2) Date: Jul. 27, 2016

(87) PCT Pub. No.: WO2015/121635

PCT Pub. Date: Aug. 20, 2015

(65) Prior Publication Data

US 2016/0348220 A1 Dec. 1, 2016

(30) Foreign Application Priority Data

Feb. 11, 2014 (GB) ..... 1402323.8

(51) Int. Cl.

| | |
|---|---|
| ***C22C 21/08*** | (2006.01) |
| ***C22C 21/00*** | (2006.01) |
| ***C22C 32/00*** | (2006.01) |
| ***B22D 21/00*** | (2006.01) |
| ***C22F 1/047*** | (2006.01) |
| ***B22D 17/00*** | (2006.01) |
| ***C22F 1/04*** | (2006.01) |

(52) U.S. Cl.

CPC ..... *C22C 32/0078* (2013.01); *B22D 17/00* (2013.01); *B22D 21/007* (2013.01); *C22C 21/00* (2013.01); *C22C 21/08* (2013.01); *C22F 1/04* (2013.01); *C22F 1/047* (2013.01)

(58) Field of Classification Search

CPC ..... C22C 21/08

See application file for complete search history.

(56) References Cited

U.S. PATENT DOCUMENTS 3,868,250 A * 2/1975 Zimmermann ..... C22C 21/08 148/417
6,773,664 B2 8/2004 Spanjers et al.

FOREIGN PATENT DOCUMENTS

| | | | |
|---|---|---|---|
| CN | 102796925 | A | 11/2012 |
| DE | 4063 | A1 | 12/1953 |
| DE | 1201562 | B | 12/1973 |
| EP | 0819778 | A2 | 1/1998 |
| EP | 0918096 | A1 | 5/1999 |
| EP | 1371741 | A2 | 12/2003 |
| EP | 1757709 | A1 | 2/2007 |
| EP | 2415889 | A1 | 2/2012 |
| JP | 03-264637 | A | 11/1991 |
| JP | 2541412 | B | 10/1996 |
| JP | 3286982 | B | 5/2002 |
| WO | WO 2005/045081 | | 5/2005 |
| WO | WO 2005/047554 | | 5/2005 |
| WO | WO 2006/122341 | | 11/2006 |

OTHER PUBLICATIONS

Yan, et al., "Effect of Excess Mg on the Microstructure and Mechanical Properties of Al-Mg2Si High Pressure Die Casting Alloys," Materials Science Forum, 2013, pp. 64-68, vol. 765.

Li, et al. metal materials (2nd edition), pp. 194-195, Beijing Institute of Technology press, Nov. 2013.

* cited by examiner

*Primary Examiner* — George Wyszomierski
*Assistant Examiner* — Janelle Morillo
(74) *Attorney, Agent, or Firm* — Joseph T. Leone; DeWitt LLP

(57) ABSTRACT

A high strength cast aluminium alloy for high pressure die casting comprising magnesium silicide 6 to 12 wt. %, magnesium 4 to 10 wt. %, X element from copper (Cu), zinc (Zn), silver (Ag), gold (Au) and Lithium (Li) at 3 to 10 wt. %, manganese 0.1 to 1.2 wt. %, iron max. 1.5 wt. %, titanium or the other grain refining elements from Cr, Nb, and Sc with 0.02 to 0.4 wt. %, and impurity and minor alloying elements at a level of maximum 0.3 wt. % and totally <0.5% of at least one element selected from scandium (Sc), zirconium (Zr), Nickel (Ni), chromium (Cr), niobium (Nb), gadolinium (Gd), calcium (Ca), yttrium (Y), antinomy (Sb), bismuth (Bi), neodymium (Nd), ytterbium (Yb), vanadium (V), chromium (Cr), beryllium (Be) and boron (B) and the remainder aluminium.

2 Claims, No Drawings

HIGH STRENGTH CAST ALUMINIUM ALLOY FOR HIGH PRESSURE DIE CASTING

This invention relates to an aluminium alloy for high pressure die casting, in particular a high strength cast aluminium alloy that in addition to aluminium comprises magnesium silicide, magnesium, manganese, titanium and at least one other enhancing element as main alloying components, the minor elements for grain refinement or property enhancement, and the elements that are inevitable impurities.

High pressure die-casting is one of well-developed technical process for manufacturing parts from aluminium alloys. The quality of a die cast parts depends on several factors including the machine parameters, the chemical composition of alloy and the process of melt preparation. It is well known that the alloy composition is one of the most critical factors and itself significantly influences the castability, feeding behaviour, mechanical characteristics and the life of casting tools.

Aluminium die cast components have achieved a particular significance in the industry where structural components are needed to suffer high stress. The increasing mechanical demands placed on aluminium die cast parts require high strength aluminium alloys. Currently, the registered die cast aluminium alloys are basically based on Al—Si, Al—Si—Cu, Al—Mg, Al—Mg—Si systems, which provide yield strength from 120 to 180 MPa, UTS from 250 MPa to 300 MPa, and elongation from 3 to 10%. These cannot satisfy the requirement of high strength where yield strength is at a level of 300 MPa, ultimate tensile strength (UTS) over 400 MPa and elongation at a level of 2%. Therefore the new alloys are essential in order to achieve high strength in the die cast components by means of special alloy composition and appropriate processing method.

From the state of the art, a number of references have disclosed the alloy compositions of cast aluminium alloys, which offer high strength. Examples of such references include WO/2006/122341, U.S. Pat. No. 6,773,664, WO/2005/047554, EP 1371741, JP54019409, and EP0819778.

In WO/2006/122341, an aluminium alloy is described a high-strength casting aluminium alloy, comprising 2.0 wt. % to 6.0 wt. % of Cu, 0.05 wt. % to 1.0 wt. % of Mn, 0.01 wt. % to 0.5 wt. % of Ti, 0.01 wt. % to 0.2 wt. % of Cr, 0.01 wt. % to 0.4 wt. % of Cd, 0.01 wt. % to 0.25 wt. % of Zr, 0.005 wt. % to 0.04 wt. % of B, 0.05 wt. % to 0.3 wt. % of rare earth element and the balancing amount of Al and trace impurities.

U.S. Pat. No. 6,773,664 discloses an aluminium-magnesium alloy for casting operations consisting of, in weight percent, Mg 2.7-6.0, Mn 0.4-1.4, Zn 0.10-1.5, Zr 0.3 max., V 0.3 max., Sc 0.3 max., Ti 0.2 max., Fe 1.0 max., Si 1.4 max., balance aluminium and inevitable impurities. The casting alloy is particularly suitable for application in die-casting operations.

WO/2005/047554 discloses an Al—Mg—Si cast aluminium alloy containing scandium. The comprises at least 1.0 to 8.0 wt. % magnesium (Mg), >1.0 to 4.0 wt. % silicon (Si), 0.01 to <0.5 wt. % scandium (Sc), 0.005 to 0.2 wt. % titanium (Ti), 0 0.5 wt. % of an element or group of elements, selected from the group comprising zirconium (Zr), hafnium (Hf), molybdenum (Mo), terbium (Tb), niobium (Nb), gadolinium (Gd), erbium (Er) and vanadium (V), 0-088 wt. % manganese (Mn), 0 0.3 wt. % chromium (Cr), 0 1.0 wt. % copper (Cu), 0 0.1 wt. % zinc (Zn), 0 0.6 wt. % iron (Fe), 0 0.004 wt. % beryllium (Be) and the remainder aluminium with further impurities to an individual max. of 0.1 wt. % and total max. of 0.5 wt. %.

In EP 1371741, a casting aluminium alloy with high-strength is disclosed, comprising 3.5 to 4.3% of Cu, 5.0 to 7.5% of Si, 0.10 to 0.25% of Mg, not more than 0.2% of Fe, 0.0004 to 0.0030% of P, 0.05 to 0.2% of Sb, and the balance comprising Al and unavoidable impurities. Also disclosed is a high-strength cast aluminium alloy obtained by casting a high-strength aluminium alloy for casting comprising 3.5 to 4.3% of Cu, 5.0 to 7.5% of Si, 0.10 to 0.25% of Mg, not more than 0.2% of Fe, 0.0004 to 0.0030% of P, 0.05 to 0.2% of Sb, 0.05 to 0.35% of Ti, and the balance comprising Al and unavoidable impurities, and subjecting the alloy thus cast to a T6 treatment.

JP54019409 discloses a high strength aluminium alloy for die casting with minimized casting crack and improved tensile strength and yield strength after heat-treatment by limiting the content of Cu, Mg, Si, Fe and so on therein.

EP0819778 discloses a high-strength aluminium-based alloy consisting essentially of a composition represented by the general formula: AlbalMnaMb or AlbalMnaMbTMc wherein M represents one or more members selected from the group consisting of Ni, Co, Fe and Cu, TM represents one or more members selected from the group consisting of Ti, V, Cr, Y, Zr, La, Ce and Mm and a, b and c each represent an atomic percent (at %) in the range of $2 \leq a \leq 5$, $2 \leq b \leq 6$ and $0 < c \leq 2$ and containing monoclinic crystals of an intermetallic compound of an Al9Co2-type structure in the structure thereof.

The Al-based alloy has excellent mechanical properties including a high hardness, high strength and high elongation.

These aluminium alloys are intended to provide improved yield strength or ultimate tensile strength with reasonable elongation for industry. The main problems associated with these alloys include at least one of following problems: (1) the strength is not sufficient to fulfil the requirement in industry; (2) a long and high temperature in the full solution treatment and a long ageing time are required to develop the potential improvement in mechanical properties; (3) some alloys only suitable for permanent mould casting and sand casting, but not applicable for high pressure die casting; (4) some alloys contain high level of costly rare earth elements and expensive materials like scandium will result in cost concerns for the products and potential supply problem during application.

Other aluminium alloys are disclosed in the following publications: JP H05163546 A (NIKKEI), JP H03264637 A (FURUKAWA), U.S. Pat. No. 3,868,250 A (ZIMMERMANN), EP 0918096 A2 (ALUSUISSE), WO 2005/045081 A1 (ARC), CN 102796925 A (UNIV), DD 4063 A (EIGENTUM), DE 1201562 B (HONSEL) and JP H04218640 A (KASEI).

The present invention seeks to provide improved aluminium alloys.

In accordance with a first aspect of the present invention, there is provided a high strength cast aluminium alloy, comprising magnesium silicide from 4 to 14 wt. %, magnesium from 4 to 12 wt. %, an amount of element X which is greater than 0 wt % but not more that 12 wt %, which is copper (Cu), zinc (Zn), silver (Ag), gold (Au) or Lithium (Li) or any combination thereof, manganese from 0.1 to 1.5 wt. %, not more than 1.5 wt % of iron, impurities and minor alloying elements at a maximum total level of 0.8 wt. % and wherein there is no more than 0.5% of any individual element selected from scandium (Sc), zirconium (Zr), Nickel (Ni), chromium (Cr), niobium (Nb), gadolinium (Gd), calcium (Ca), yttrium (Y), antinomy (Sb), bismuth (Bi), neodymium (Nd), ytterbium (Yb), vanadium (V), chromium (Cr), beryllium (Be) and boron (B), and the remainder of the alloy is aluminium.

Preferred alloys in accordance with the invention have excellent strength and capable manufacturing with high pressure die casting, in particular for the alloy having yield strength over 300 MPa, UTS over 400 MPa and elongation at a level of 2%.

It is believed that the improved balance of properties available with the present invention, particularly the higher strength and appropriate ductility, results from the combination of the alloying elements $Mg_2Si$, Mg, Mn and at least one other major element for strengthening and at least one other minor addition of special elements for grain refinement or strength enhancement in the given ranges with inevitable impurities.

Magnesium silicide ($Mg_2Si$) is a combination of magnesium and silicon at a ratio of 1.73:1. $Mg_2Si$ is a pseudo element to form pseudo-eutectic alloy with aluminium and provides primary strengthening in the Al—$Mg_2Si$ alloy, in which the prior phase is $\alpha$-Al when $Mg_2Si$ is less than 13.9 wt. %. Therefore, $Mg_2Si$ can provide solution strengthening and precipitation strengthening. $Mg_2Si$ is also for the improvement of castability and reduces casting defects including hot tearing and inclusions. However, the increased $Mg_2Si$ will reduce the ductility of casting. As such, the $Mg_2Si$ level is kept between 4 to 14 wt. %. Preferably the amount of $Mg_2Si$ is kept between 6 to 10 wt. %, most preferably from 6 to 10 wt %. However, Al—$Mg_2Si$ is not die-castable in high pressure die casting as the severe die soldering problem.

Mg is a primary element for strengthening in aluminium alloy. Mg has a high solubility of 14.9 wt % in aluminium. Mg levels above 4.0 wt. % do provide the enhancement in cast aluminium alloys for improved mechanical properties. More importantly, excess Mg in Al—$Mg_2Si$ alloy can eliminate the casting problem of die soldering. This makes the Al—$Mg_2Si$ alloy die-castable with further property enhancement from Mg strengthening. Moreover, excess magnesium in Al—$Mg_2Si$ system alters the eutectic reaction point and reduces the $Mg_2Si$ content in the eutectic alloy. This is means that the microstructure can be controlled through the variation of excess Mg content in the Al—$Mg_2Si$ alloy. However, the amount of Mg should not exceed 12 wt. % in order to ensure an acceptable ductility in the alloy. Preferably, the excess Mg content in the alloy is more than 4 wt. % and less that 10 wt. % (most preferably from 5 to 7 wt %) by which the alloy is provided with a better balance of yield strength, tensile strength, and ductility as measured by its elongation.

Manganese is also an additive element in the alloy. It helps to prevent die soldering and can provide the strength enhancement in the alloy. More importantly, Mn combines with Fe to alter the morphology of Fe-containing compounds from needles to nodular to reduce the harmful effect of Fe. A range for the Mn content is kept between 0.1 to 1.5 wt. %, Preferably the amount of Mn is between 0.2 to 0.8 wt. %, most preferably from 0.4 to 0.7 wt %.

At least one element X is essential in the developed alloy as the major strengthening element. The amount of X element has been found to increase the yield strength whilst scarifying the ductility of the alloy. Normally in the art, a deliberate X addition is required if the subsequent solution and ageing is a preferred option to improve the yield strength and elongation. Preferably, the amount of X is varied for different elements, but the preferred amount does not exceed 12 wt. %. The element can be selected at least one from copper (Cu), zinc (Zn), silver (Ag), gold (Au), scandium (Sc) and lithium (Li). Preferably, the amount of element X is from 3 to 6 wt. %.

Titanium is often used as a grain refiner during solidification of casting produced using the alloy of the invention. This effect is obtained with a Ti content of less than 0.4 wt. %, preferably less than 0.20 wt. % and most preferably from 0.10 to 0.15 wt. %. Ti may be replaced in part or in whole by V, Cr and/or Zr in the same compositional range to achieve a similar effect, or by any other elements from Cr, Nb, and Sc that have grain refinement functions.

Fe is an unavoidable detrimental element in diecast aluminium alloys in terms of mechanical properties and corrosion resistance. It tends to form Fe-containing compounds in needle shape during die casting. The end of needles is always to initial the cracks of failure. Therefore Fe needs to be controlled in the alloy. However, Fe is beneficial for strength enhancement, in particular the yield strength. Therefore, an amount of 1.5 wt. % is acceptable in terms of the mechanical properties of the alloy. However, if the corrosion resistant is a main concern for the alloy, the Fe content should be limited below 0.5 wt. %, preferably below 0.3 wt. %.

There are some elements that exist as grain refiner, or as alloying elements at minor amount, or as impurities. An individual is at a level of maximum of 0.3 wt. % (preferably 0.25 wt %) and in total less than 0.5% of at least one element selected from zirconium (Zr), niobium (Nb), gadolinium (Gd), calcium (Ca), yttrium (Y), antinomy (Sb), bismuth (Bi), neodymium (Nd), ytterbium (Yb), vanadium (V), chromium (Cr), beryllium (Be) and boron (B).

In a further aspect of the invention, there is provided a high strength cast aluminium alloy, comprising magnesium silicide from 4 to 14 wt. %, magnesium from 4 to 12 wt. %, not more that 12 wt % of element X, which is copper (Cu), zinc (Zn), silver (Ag), gold (Au) or Lithium (Li) or any combination thereof, manganese from 0.1 to 1.5 wt. %, not more than 1.5 wt % of iron, impurities and minor alloying elements at a maximum total level of 0.8 wt. % and wherein there is no more than 0.5% of any individual element selected from scandium (Sc), zirconium (Zr), Nickel (Ni), chromium (Cr), niobium (Nb), gadolinium (Gd), calcium (Ca), yttrium (Y), antinomy (Sb), bismuth (Bi), neodymium (Nd), ytterbium (Yb), vanadium (V), chromium (Cr), beryllium (Be) and boron (B), and the remainder of the alloy is aluminium.

In a preferred embodiment, said alloy comprises magnesium silicide from 5 to 14% by weight, magnesium from 3 to 12% by weight, from 2 to 12% by weight of element X, manganese from 0.1 to 1.2% by weight, titanium from 0.02 to 0.4% by weight, not more than 1.5 wt. % iron and impurity elements at a level of maximum 0.3 wt. % for any one element and in total not more than 0.3%.

Certain embodiments of the present invention may be further understood by reference to the following specific examples. These examples and the terminology used herein are for the purpose of describing particular embodiments only and are not intended to be limiting.

EXAMPLE A

An alloy that has the following composition:

magnesium silicide from 5 to 14 wt. %, magnesium from 3 to 12 wt. %,

X element from copper (Cu), zinc (Zn), silver (Ag), gold (Au) and Lithium (Li) from 2 to 12 wt. %, Manganese from 0.1 to 1.2 wt. %, iron maximum 1.5 wt. %, titanium or the other grain refining elements from Cr, Nb, and Sc with 0.02 to 0.4 wt. %, and impurity and minor alloying elements at a level of maximum 0.3 wt. % and totally <0.5% of at least one element selected from zirconium (Zr), niobium (Nb), gadolinium (Gd), calcium (Ca), yttrium (Y), antinomy (Sb), bismuth (Bi), neodymium (Nd), ytterbium (Yb), vanadium (V), chromium (Cr), beryllium (Be) and boron (B).

and the remainder aluminium.

EXAMPLE B

An alloy that has the following composition:

magnesium silicide from 6 to 10 wt. %, magnesium from 4 to 9 wt. %,

X element from copper (Cu), zinc (Zn), silver (Ag), gold (Au) and Lithium (Li) from 3 to 8 wt. %, manganese from 0.3 to 0.8 wt. %, titanium or the other grain refining elements from Cr, Nb, and Sc with 0.08 to 0.3 wt. %, iron maximum 0.7 wt. %, impurity and minor alloying elements at a level of maximum of 0.2 wt. % and totally <0.4% of at least one element selected from zirconium (Zr), niobium (Nb), gadolinium (Gd), calcium (Ca), yttrium (Y), antinomy (Sb), bismuth (Bi), neodymium (Nd), ytterbium (Yb), vanadium (V), chromium (Cr), beryllium (Be) and boron (B).

and the remainder aluminium.

EXAMPLE C

An alloy that has the following composition:

magnesium silicide from 6 to 9 wt. %, magnesium from 5 to 7 wt. %,

X element from copper (Cu), zinc (Zn), silver (Ag), gold (Au) and Lithium (Li) from 3 to 6 wt. %, manganese from 0.4 to 0.7 wt. %, titanium or the other grain refining elements from Cr, Nb, and Sc with 0.10 to 0.25 wt. %, iron maximum 0.3 wt. %, impurity and minor alloying elements at a level of maximum of 0.2 wt. % and totally <0.25% of at least one element selected from zirconium (Zr), niobium (Nb), gadolinium (Gd), calcium (Ca), yttrium (Y), antinomy (Sb), bismuth (Bi), neodymium (Nd), ytterbium (Yb), vanadium (V), chromium (Cr), beryllium (Be) and boron (B).

and the remainder aluminium.

The results of the tensile tests carried out are listed in Table 1. In the case of the alloys listed therein the alloys of tests 1 to 8 are in accordance with the invention; the reference alloy represents an alloy the composition of which corresponds to an alloy in accordance with the invention, but does not contain any grain refiner.

TABLE 1

| | | Tensile strength (MPa) | Yield strength (MPa) | Breaking elongation (%) |
|---|---|---|---|---|
| 1 | Al8$Mg_2$Si6Mg4.5X0.6Mn0.2Ti | 350 | 250 | 2.8 |
| 2 | Al6$Mg_2$Si6Mg4X0.6Mn0.2Ti | 330 | 230 | 3.5 |
| 3 | Al8$Mg_2$Si6Mg4.3X0.6Mn0.3Cr | 345 | 234 | 3.6 |
| 4 | Al8$Mg_2$Si6Mg3.5X0.6Mn | 350 | 245 | 2.1 |
| 5 | Al10$Mg_2$Si4Mg3.5X0.6Mn | 330 | 230 | 2.5 |
| 6 | Al8$Mg_2$Si6Mg4.5X | 340 | 235 | 4.0 |
| 7 | Al8$Mg_2$Si6Mg4X0.6Mn0.3Fe | 325 | 175 | 6.1 |
| 8 | Al8$Mg_2$Si6Mg0.6Mn | 340 | 180 | 7.0 |
| 9 | Al8$Mg_2$Si6Mg | 330 | 170 | 7.5 |

As it can be seen from the table, the adding of X element can result in a significant increase of the yield strength and UTS with accepted elongation. The alloys under as-cast condition can offer a high yield strength and ultimate tensile strength with reasonable ductility. The mechanical properties can be further improved with a quick T6 treatment. It is also seen that the grain refinement is useful in this alloy to improve mechanical properties.

In an embodiment the alloy is subjected to a quick heat treatment for further improvement of mechanical properties. The quick heat treatment consists of two stages: a short time of solution treatment and a short time of ageing treatment. The results of the tensile tests carried out for the mechanical properties after solution and/or ageing treatment are listed in Table 2, in which the high temperature over 450° C. is for solution treatment and the low temperature below 200° C. is for ageing treatment. The process only with high temperature treatment indicates that the alloy is treated by solution only and no ageing is applied to the alloy. Similarly, the process only with low temperature treatment indicates that the alloy is treated by ageing only and no solution is applied to the alloy. In the case of the alloys listed therein the alloys of tests 1 to 8 are in accordance with the invention.

TABLE 2

| | | Tensile strength (MPa) | Yield strength (MPa) | Elongation (%) |
|---|---|---|---|---|
| 1 | Al8$Mg_2$Si6Mg4.5X0.6Mn0.2Ti 15 mins@490° C. and 90 mins@180° C. | 440 | 350 | 4 |
| 2 | Al8$Mg_2$Si6Mg4.5X0.6Mn0.2Ti 15 mins@490° C. | 336 | 200 | 7 |
| 3 | Al8$Mg_2$Si6Mg4.5X0.6Mn0.2Ti0.3Cr 15 mins@490° C. and 90 mins@180° C. | 440 | 350 | 3 |
| 4 | Al8$Mg_2$Si6Mg4.5X0.6Mn0.2Ti0.3Cr 15 mins@490° C. | 380 | 260 | 5 |
| 5 | Al7$Mg_2$Si5Mg5X0.6Mn0.2Ti 15 mins@490° C. and 90 mins@180° C. | 460 | 390 | 3 |
| 6 | Al7$Mg_2$Si5Mg5X0.6Mn0.2Ti 10 mins@490° C. and 60 mins@180° C. | 445 | 380 | 3 |
| 7 | Al7$Mg_2$Si5Mg4X0.6Mn0.2Ti 15 mins@490° C. and 90 mins@180° C. | 420 | 340 | 3 |
| 8 | Al8$Mg_2$Si6Mg4.5X0.6Mn 15 mins@490° C. and 90 mins@180° C. | 410 | 330 | 2.5 |

As it can be seen from the table, the short term solution can increase the elongation and short time of ageing can improve the strength. The best combination is provided by the quick solution and subsequent ageing heat treatment. Therefore, it is a preferred heat treatment in this invention.

All optional and preferred features and modifications of the described embodiments and dependent claims are usable in all aspects of the invention taught herein. Furthermore, the individual features of the dependent claims, as well as all optional and preferred features and modifications of the described embodiments are combinable and interchangeable with one another.

The disclosures in UK patent application number 1402323.8, from which this application claims priority, and in the abstract accompanying this application are incorporated herein by reference.

The invention claimed is:

1. An aluminium alloy comprising:

magnesium silicide from 5 to 14 wt %, excess magnesium from 4 to 12 wt %, from 2 to 12 wt % element X, wherein element X is selected from the group consisting of copper (Cu), zinc (Zn), silver (Ag), gold (Au), lithium (Li), and combinations thereof, manganese from 0.1 to 1.2 wt %, titanium from 0.02 to 0.4 wt %, not more than 1.5 wt % iron, and impurity elements at a level of maximum 0.3 wt % for any one element and in total not more than 0.3 wt %, and the remainder of the alloy is aluminium.

2. An aluminium alloy comprising:

magnesium silicide from 6 to 10 wt %, excess magnesium from 4 to 9 wt %, from 3 to 8 wt % of element X, wherein element X is selected from the group consisting of copper (Cu), zinc (Zn), silver (Ag), gold (Au), lithium (Li), and combinations thereof, manganese from 0.3 to 0.8 wt %, titanium from 0.08 to 0.3 wt %, not more than 0.7 wt % iron, and impurity elements at a level of maximum 0.2 wt % for any one element and in total not more than 0.25 wt %, and the remainder of the alloy is aluminium.

* * * * *